United States Patent [19]

Thompson et al.

[11] Patent Number: 4,915,541

[45] Date of Patent: Apr. 10, 1990

[54] METHOD AND APPARATUS FOR CONTINUOUSLY BORING AND LINING TUNNELS AND OTHER LIKE STRUCTURES

[76] Inventors: Louis J. Thompson, 1216 Haines, College Station, Tex. 77840; Peter M. McIntyre, 713 E. 30th St., Bryan, Tex. 77801; James K. Carta, 3610 Bluebonnet Cir., Weatherford, Tex. 76086

[21] Appl. No.: 204,691

[22] Filed: Jun. 9, 1988

Related U.S. Application Data

[63] Continuation-in-part of Ser. No. 122,534, Nov. 12, 1987, Pat. No. 4,793,736, which is a continuation of Ser. No. 766,919, Aug. 19, 1985, abandoned.

[51] Int. Cl.[4] ..... E21D 11/10; E21D 9/06

[52] U.S. Cl. ..... 405/146; 405/150; 405/141

[58] Field of Search ..... 405/141-146, 405/150, 155, 184

[56] References Cited

U.S. PATENT DOCUMENTS

| | | | |
|---|---|---|---|
| 3,959,977 | 6/1976 | Godbersen | 405/155 |
| 4,437,789 | 3/1984 | Kasiewicz | 405/155 X |
| 4,629,363 | 12/1986 | Rose et al. | 405/155 |
| 4,793,736 | 12/1988 | Thompson et al. | 405/150 X |

*Primary Examiner*—Randolph A. Reese
*Assistant Examiner*—Arlen L. Olsen

[57] ABSTRACT

Disclosed is a continuous tunneling and lining machine. The machine is capable of simultaneously boring and lining a tunnel through a solid medium. The machine comprises four major components including: (1) an excavation system; (2) a debris removal system; (3) a lining system; and (4) a liner material retrieval system. The excavation system comprises a rotary excavator that excavates the tunnel bore. The lining system mixes liner materials at the bulkhead and pumps the mixed material into slipform. The slipform comprises an inner form, an outer form and a wall connecting the inner and outer form and at least one mandrel. The mandrels form cast in place passageways to accommodate liner component retrieval and excavation debris removal. The debris removal system pumps excavation debris through the excavated area into the mandrels and out the cast in place passageways. Finally, the liner material system comprises a plurality of pumps that pump individual liner component materials through the cast in place passageway, through the pipe mandrels and to the lining system. There the material components are mixed and pumped into the liner.

5 Claims, 6 Drawing Sheets

METHOD AND APPARATUS FOR CONTINUOUSLY BORING AND LINING TUNNELS AND OTHER LIKE STRUCTURES

BACKGROUND OF INVENTION

This application is a continuation-in-part application of Ser. No. 07/122,534, filed on Nov. 12, 1987, now U.S. Pat. No. 4,793,736, issued on Dec. 27, 1988; which is a continuation application of Ser. No. 06/766,919, filed on Aug. 19, 1985, now abandoned.

TECHNICAL FIELD

The present invention relates generally to an apparatus and system for continuously excavating and lining tunnels through a solid medium. More particularly, invention relates to an apparatus that simultaneously and continuously excavates and lines tunnels over large distances without the need to stop the apparatus to add material removal and retrieval equipment.

BACKGROUND ART

Underground and underwater tunnels serve many purposes. Tunnels have been and are used as: Aqueducts to provide cities with water; passageways through mountains for automobiles and railroads; sewer systems; and storage areas.

Multi-layered tunnels form the substructure of many large cities in the United States. These tunnels house subways, walkways, waterways, utility lines and sewer systems. In many cities the tunnels need to be repaired or replaced.

More recently, tunnels have been proposed for use in scientific experiments to study the essence of matter and energy. These tunnels will house large particle accelerators. The tunnels are needed for safety purposes and to isolate the particles for experimental control.

Tunnels were originally dug by hand. Timber was used to support the bore. Later, mechanical hoes and dynamite were used to excavate the tunnel bore. In many instances it is beneficial to line the tunnel bore. Lining the tunnel supports the bore, prevents cave-ins and flooding. In most cases, concrete linings have replaced timber to support and line the tunnel bore. The excavation and lining were originally done as separate operations.

Now, tunneling machines are capable of simultaneously and continuously excavating and lining tunnels. Most of these machines include four major components. The major components included are: (1) an excavator to bore the tunnel; (2) a excavation debris removal system; (3) a tunnel lining system; and (4) a liner material retrieval system.

Many of the modern machines employ rotary excavators. The excavators are driven by at least one motor. They are usually propelled forward and guided by a plurality of hydraulic thrusters.

Excavation debris removal is an important function of every continuous tunneling machine. The rate of debris removal is directly related to the rate at which a tunnel bore is dug. Moreover, a machine cannot perform without a properly functioning excavation debris removal system.

There are several excavation debris removal systems now in use. Examples of the systems include mechanical backlogs, conveyor belts and pressurized pipe systems.

All of those systems are helpful in removing excavation debris. Unfortunately, each of the systems require that the machine be stopped periodically to add additional debris removal equipment. For example, the pressurized pipe systems include telescoping pipes to accommodate the forward movement of the machine. However, when the telescoping pipe is fully extended the machine must be stopped to add new pipe.

Stopping the tunneling machine reduces efficiency and momentum. Furthermore, restarting the machine requires the excavator to overcome static torque when it engages the solid medium. The restarts occasionally cause the excavators cutting bits to fail causing further delays. Consequently there exists a need for a machine capable of reducing or removing the number of times the machine must be stopped.

Modern tunneling machines employ either segmented forms or slipforms in their tunneling lining systems.

Segmented lining systems included a plurality of individual forms. The forms are set up in series behind the excavator. Concrete is pumped in between the form and the excavated bore to form the tunnel's lining.

As the machine advances, the segmented forms farthest from the excavator are brought forward to the excavator. Those forms are placed immediately behind the excavator to and are attached to the form closest to the excavator. Additional equipment is required to move the forms from the positions farthest from the excavator to the closest.

The slipform lining systems include an outer and inner form. The outer form usually houses the excavator and other components of the machine. Also, the outer form is usually shaped to the bore excavated by the excavator. The inner slipform is shaped to the interior contours of the tunnel. Concrete is pumped between the inner and outer forms to form the tunnel's lining.

Most systems now in use include liner material retrieval systems. Many of the systems include pumps to bring liner material from a remote location to the excavation area. There the concrete is pumped into either the segment or slipforms.

This can be a difficult task. Concrete does not travel well over long distances through pipes. Hardening may occur and clog the pipe. The composition of the cement can be adjusted for proper flow. Such compositions can increase the time required for the concrete to cure.

Another liner material retrieval system includes conveyor belts. Conveyor belts move freshly mixed cement from a remote location to the head of the excavator. The concrete is then injected by either pumping or spraying into the forms.

Again the liner material must travel long distances to reach the most recently excavated area. Because the materials must travel great distances hardening is a problem.

Consequently there is a need for a better means of bringing lining materials to the excavation head for introduction into the forms.

Another problem with the present liner material retrieval is the need to add additional pipe or conveyors. Even with telescoping pipes, the machine must be stopped occasionally. Thus, the same stopping and restart problems associated with the debris removal system are also present with the material retrieval system.

SUMMARY OF THE INVENTION

The present invention addresses and overcomes problems encountered by modern continuous tunneling machines. Specifically, the present invention overcomes the problems associated with excavation debris removal and liner material retrieval. The features of this invention are especially helpful when digging long continuous tunnels where excavation debris and liner materials must travel a great distance.

This invention enhances the art of continuous tunneling machines by providing a plurality of multiple use passage ways cast into the tunnel lining.

Briefly the invention comprises a machine that simultaneously and continuously excavates and lines a tunnel bore. The machine includes five major components: (1) an excavator, (2) an excavation debris removal system, (3) a lining system (4) a liner material retrieval system and (5) a control system.

The invention employs a rotary type excavator. The excavator is driven by a plurality of electric motors. Hydraulic thrusters guide and propel the excavator forward.

The tunnel lining system features a slipform. The slipform includes an outer form, an inner form, a wall connecting the inner form with the outer form and at least one hollow mandrel. The mandrel is attached to the wall and is disposed between the inner and outer forms.

As the machine is driven forward, the tunneling lining system pumps concrete mixed at the bulkhead into the slipform. The resulting tunnel lining features a plurality of passageways formed in the lining by the mandrels.

The passageways serve several different functions. During excavation, the passageways serve as conduits to remove excavation debris and to bring liner materials to the bulkhead. After excavation is complete, the passageways may house utility lines and the like (i.e. water, power, telephone and the like). The cast in place passageways also remove the need to stop the tunneling machinery to add debris removal and liner material retrieval equipment.

Another feature of the invention is the liner material mixing system. The components of the liner material are mixed at the bulkhead. This feature removes the problem of the concrete clogging and setting within pipelines or setting on conveyors before the material reaches the bulkhead.

Separate liner material components are sent to the bulkhead for mixing at the bulkhead. Such mixing allows the machine to adjust the composition of the concrete at the bulkhead. This allows the liner material to be adapted to the environmental conditions at the bulkhead.

The present invention may also include a passageway lining system. The passageway lining system lines the cast in place passageways with a sheet material lining. The material lining helps protect the passageways from erosion, wear and the like.

The features and aspects of the present invention were provided to show how this invention overcomes some of the problems associated with the prior art. Other aspects and features of this invention will become more apparent when reading the specification in view of the drawings attached.

DETAILED DESCRIPTION OF THE DRAWINGS

Figure 1:
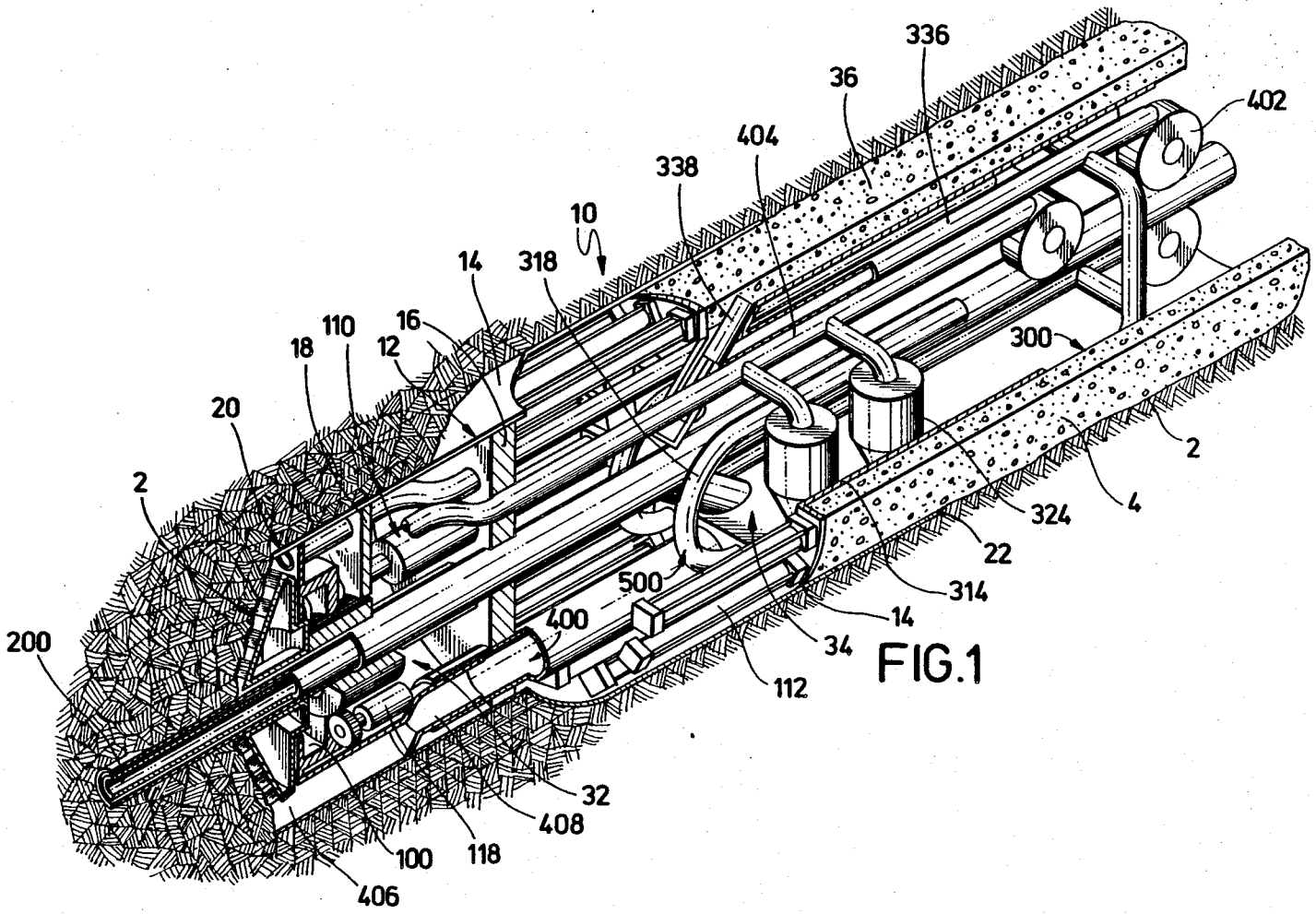
FIG. 1 is a partially cut away perspective view of a continuous tunneling machine.

Illustrated in FIG. 1 is a unitized continuous tunnel boring and lining machine 10. Machine 10 is made up of five major units. The five major units include (1) an excavation system 100 that excavates a bore 2; (2) a guidance system 200 that directs the machine 10; (3) a tunnel lining system 300 that forms a tunnel lining 4; (4) an excavation debris removal system 400; and (5) a liner material retrieval system 500.

MAIN STRUCTURE

Illustrated in FIG. 1 is a tunnel machine 10. The machine 10 has a main structure 12 that includes a housing 14, a bulkhead 16, and a shield 18. The housing 14 has an excavator end 20 and a liner end 22.

The housing 14 is shaped to fit the bore 2 excavated by the excavation system 100. FIG. 1 depicts the housing 14 in its preferred cylindrical shape. Although the preferred cross-section of the housing 14 is circular, any cross-section that a standard excavation system is capable of boring is available.

The housing 14 serves two purposes. First, the housing 14 shields and supports the machine's five major units. Second, the housing 14 serves as an outer slip form for the tunnel lining system 300. The latter purpose will be discussed in greater detail in the tunnel lining system 300 section of this specification.

Figure 2:
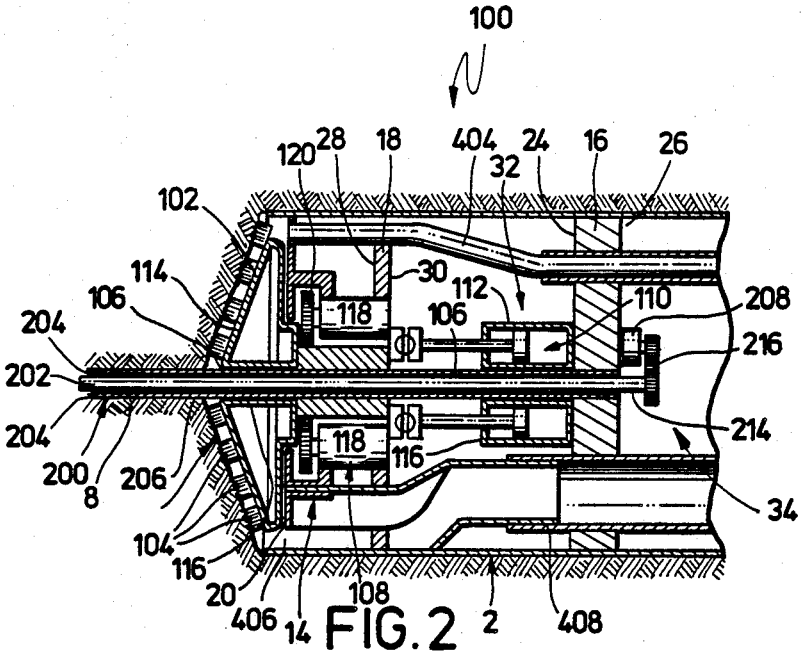
FIG. 2 is an isolated sectional side view of an excavation compartment.

The bulkhead 16, as shown in FIGS. 1 and 2, is a wall having a excavator side 24 and a liner side 26. The bulkhead 16 is shaped to fit the inside periphery of the housing 14. The bulkhead 16 is mounted essentially normal to the longitudinal axis of the housing 14. It is preferred for the bulkhead 16 to be centrally positioned within the housing 14.

The bulkhead 16 provides annular support for the housing 14. The bulkhead 16 also supports and positions the components of the machine's five major units.

The shield 18 is a wall that includes an excavator side 28 and a liner side 30. Much like the bulkhead 16, the shield 18 is shaped to the internal peripheral dimensions of the housing 14. The shield 18 is mounted essentially normal to the longitudinal axis of the housing 14. The shield 18 is positioned between the housing's excavator end 20 and the bulkhead 16.

The space formed in the housing 14 between bulkhead 16 and the excavator end 20 is defined as the excavator compartment 32. The spaced formed in the housing 14 between the bulkhead 16 and the housing's liner end 22 is defined as the rear compartment 34.

Shield 18 provides some annular support for the housing 14. The shield 18 also provides major support for the components of the excavation system 100. In the preferred embodiment, the shield 18 provides a water and air tight seal. The, seal protects the components housed in the rear compartment 34 from water damage.

In operation the main structure 12 maintains and supports the unlined bore 2 of the tunnel 6. More particularly, the housing 14, supported internally by the bulkhead 16 and the shield 18, helps present the bore from caving in. The main structure 12 also serves to house, support and protect the tunneling machine's five major units.

EXCAVATION SYSTEM 100

Illustrated in FIG. 2 is the excavation system 100. The excavation system 100 is disposed in the excavation compartment 32. The excavation system 100 includes a cutter head 102, a plurality of cutter bits 104, a shaft 106, the shield 18, a drive means 108, a guide means 110, the bulkhead 16 and a thrust means 112.

The preferred embodiment is depicted in FIG. 2. The cutter head 102 is cone-shaped having a tapered surface 114 and a flat surface 116. The cone-shaped surface 114 extends past the excavator end 20 of the housing 14 and into the solid medium 8 being excavated. A plurality of cutter bits 104 are mounted on the cone-shaped surface 114 of the cutter head 102.

A cylindrical shaft 106 is concentrically mounted on the flat surface 116 of the cutter head 102. The other end of the shaft 106 is rotatably and concentrically mounted into the shield 18. In the preferred embodiment the shaft 106 is bored out to accommodate the guidance system 200.

At least one drive means 108 is provided to drive the shaft 106. Preferably the drive means 108 is coupled to the excavator side 28 of the shield 18. The drive means 108 includes a plurality of electric motors 118 that are rotatably coupled with the shaft 106. Several different coupling means 120 are available to transmit the rotational motion of the drive means 108 to the shaft 106. The available coupling means 120 include belts, gears and other like systems. A preferable gear system/coupling means 120 is depicted in FIG. 2.

A guide means 110 is provided to insure that the cutter head 102 is being properly directed. FIG. 2 shows a plurality of hydraulic thrusters that serve as a guidance means 110. The guidance means 110 is controlled by the guidance system 200. The guidance system 200 will be discussed in greater detail in the next section of this specification.

Figure 6:
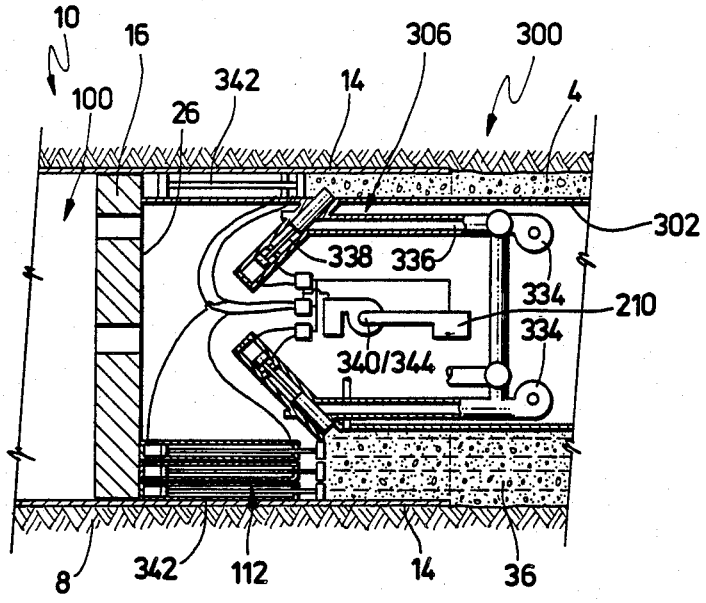
FIG. 6 is a sectional side view of a propulsion system and liner material injection subsystem.

Shown in FIG. 6 is a thrust means 112. The thrust means 112 drives the excavation system 100 into the solid medium 8 being excavated. The thrust means 112 may be obtained through several different devices. For instance, the cutter head 102 and bits 104 may be formed in the shape of a screw (not shown). As the cutter head is rotated the screw configuration will drive the excavation system 100 forward into the solid medium 8.

Another example is depicted in FIG. 6 as the preferred embodiment. The preferred thrust means 112 includes a plurality of hydraulic thrusters. The hydraulic thrusters 112 are mounted to the liner side 26 of the bulkhead 16. The other end of the hydraulic thrusters 112 are in contact with the liner material 36 in the tunnel lining system 300.

The liner material 36 is minimally compressible. In operation, as the thrusters 112 push against the liner material 36, the machine 10 will be pushed into the solid medium 8. More particularly, as the thruster 112 pushes against the liner material 36, the bulkhead 16 is pushed forward. The bulkhead 16 simultaneously transmits the thrust to the shaft 106. The shaft 106 then forces the cutting head 102 into the solid medium 8.

In operation, the excavation system 100 excavates a bore 2 and drives the machine 10 forward. More particularly, as cutter head 102 is driven forward by the thrust means 112 and rotated by the drive means 108, the cutter bits 104 excavate the bore 2 through the solid medium 8.

COMPUTERIZED GUIDANCE SYSTEM 200

FIG. 2 illustrates the machine's computerized guidance system 200. In general, the computerized guidance system provides a means of instantaneously adapting the tunneling machines major components to environmental changes in the solid medium 8. The guidance system 200 comprises a probe 202, a cutter head 204, a drive shaft 206, a drive means 208, a computer 210 (not shown), and transmitting means 214.

Typically the drive shaft 206 will be rotatably and concentrically mounted within the excavator's shaft 106. The drive shaft 206 is rotatably driven by a drive means 208.

The drive means 208 is preferably mounted on the liner side 26 of the bulkhead 16. In the preferred embodiment, the drive means 208 includes an electric motor that transmits rotational motion through a coupling means 216 to the drive shaft 206. The rotational motion of the electric motor may be transmitted to the drive shaft 206 by a gear, pulley, belt or other like motion transfer and coupling means.

The cutter head 204 and a probe 202 are mounted at the excavation end of the drive shaft 206. The cutter head 204 of the guidance system 200 drills a pilot hole. The pilot hole extends past the lead edge of the excavator's cutter head 102. Air is transmitted through the inner periphery of the hollow drive shaft 206 to remove the excavation muck from the cutter head 204.

The probe 202 is mounted ahead of the cutter head 204. The probe 202 provides data relating to the solid medium's characteristics and condition. The data obtained through the probe 202 is delivered to a computer 210 by a transmitting means 214.

There are several means of transmitting the data from the probe 202 to the computer. Such means include, but are not limited to, wire, radio transmission and the like.

When the computer 210 receives the data, the data is evaluated to determine how to adapt the machine's other systems to the characteristics of the upcoming solid medium 8.

The soil characteristics and conditions through which a tunneling machine 10 travels are important parameters for several reasons. The parameters help indicate the proper cutter head 102 speed, the machine's direction, the rate at which liner material 36 is fed into the slip form 302, and the thrust required to drive the machine 10 through the solid medium 8. Consequently, the use of a computer 210 to evaluate data concerning upcoming conditions and then transmit instructions to the tunneling machine's major systems helps maintain a continuous tunneling rate.

In the preferred embodiment, a CON-COR guidance system is used to obtain data concerning the upcoming conditions of the solid medium. The CON-COR system is commercially available through the Walker-Neer Manufacturing Company of Wichita Falls, Tex.

In operation the guidance system 200 drills a pilot hole some distance ahead of the machine's main cutter head 102. The guidance system's probe 202 then transmits data relating to the conditions and characteristics of the solid medium 8 to the computer 210 by the transmitting means 214. After analyzing the data the computer 210 ascertains the needs of the machine 10. The computer 210 then instructs the systems to adapt accordingly.

TUNNEL LINING SYSTEM 300

Depicted in FIGS. 3, 4, 5 and 6, is a tunnel lining system 300. The tunnel lining system 300 is located in the machine's rear compartment 34.

The tunnel lining system 300 includes three subsystems. The subsystems include (1) a slip form 302; (2) a liner component material mixing system 304; and (3) a liner material injection system 306. The tunnel lining system 300 continuously lines the tunnel bore 2 at or near the same rate that the excavation system 100 excavates the tunnel bore 2.

Slipform Subsystem 302

Figure 3:
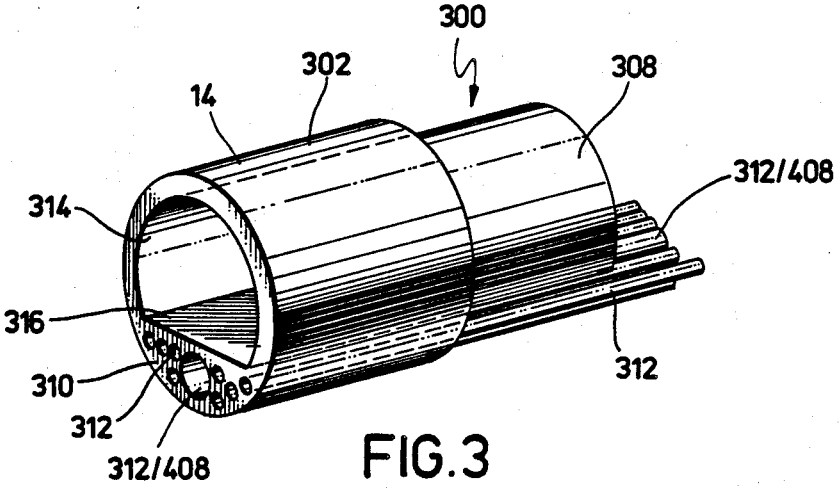
FIG. 3 is a partially cut away perspective view of a slipform of the present invention.

The slip form subsystem 302 is best shown by FIG. 3 and includes the housing 14 as an outer slip form, an inner slip form 308, a connecting wall 310 and at least one pipe mandrel 312.

The outer slip form/housing 14 is essentially the same shape as the tunnel bore 2. In the preferred embodiment the outer form 14 is cylindrically shaped.

The inner slip form 308 is not necessarily uniform in shape as is the preferred case with the outer slip form 14. Rather, the inner slip form 308 forms the internal features of the tunnel. For instance, the inner slip form 308 might be shaped to form a flat road bed inside the tunnel, a continuous rail for train system or any number of other configurations.

The preferred embodiment of the present invention includes an inner slip form 308 shaped like a flat tire (i.e., a cylindrical top 314 and a straight bottom 316). This configuration is depicted best in FIG. 3. The inner form 308 forms roadway through the tunnel 6 as the tunneling machine 10 advances.

The connecting wall 310 connects and fixes the dimensional relationship between the inner form 308 and the outer form 14. The wall 310 also serves to fix and position pipe mandrels 312. Preferably, the wall 310 lies normal to the longitudinal axis of the inner form 308, outer form 14, and mandrel 312.

Figure 4:
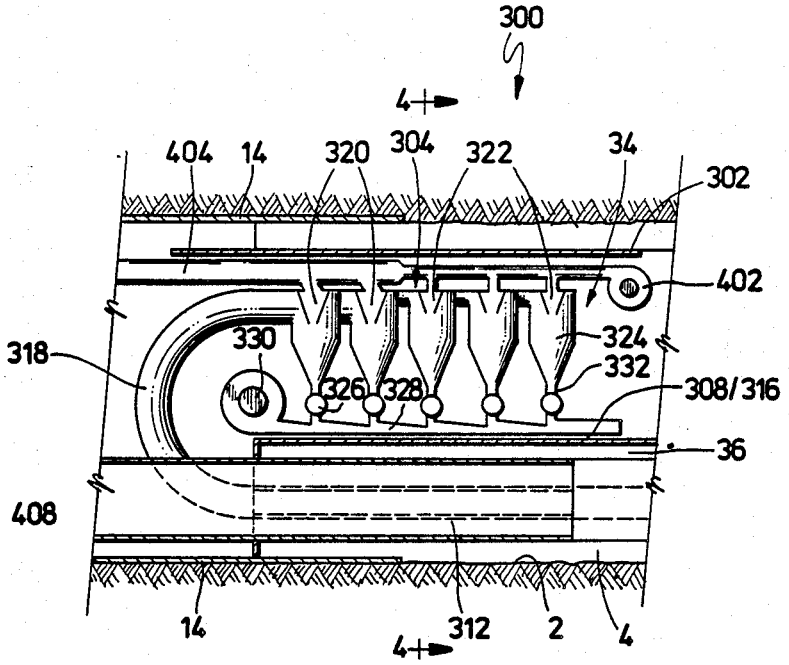
FIG. 4 is a sectional side view of a liner material retrieval and mixing system.
Figure 5:
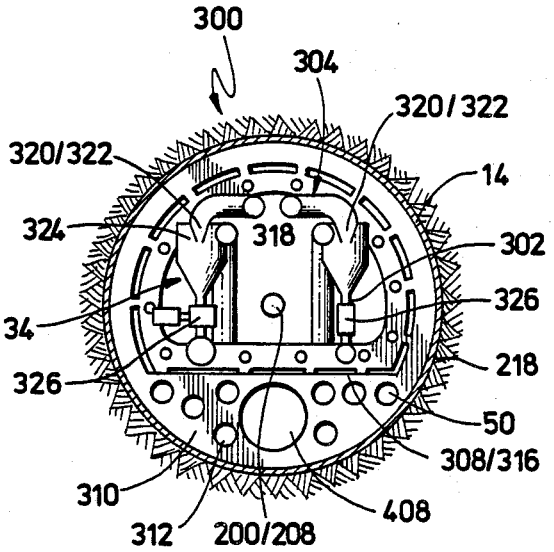
FIG. 5 is a section frontal view of FIG. 4 along 4—4 showing a liner material mixing system and the retrieval and removal pipelines.

Pipe mandrels 312 are depicted in FIGS. 3, 4 and 5. The pipe mandrels 312 are preferably cylindrical having a circular cross section. However, the mandrel's cross-section could include almost all conceivable continuous cross-sections.

The pipe mandrels 312 continuously cast passageways 50 in the tunnel lining 4 as the machine 10 advances. The passageways 50 are used to transport materials during or after excavation operations have ceased. For example, the passageways 50 serve as conduits for the excavation debris removal system 400 and the liner material retrieval system 500 during excavation. The passageways 50 may also be used to house power lines, utility lines and the like after the tunnel is finished.

Liner Material Mixing Subsystem 304

FIGS. 4 and 5 depict the liner component material mixing subsystem 304. The subsystem 304 is located in the rear compartment 34. The subsystem 304 includes feed pipes 318, the pipe mandrels 312, hydraulic separators 320, pneumatic separators 322, storage bins 324, feed means 326, pipes 328, and a material mixing means 330.

Liner material components are delivered to the liner component material mixing subsystem 304 by the liner material retrieval system 500. Each individual liner component material 305 is transported through individual feed pipes 318 to either a hydraulic 320 or a pneumatic 322 separator.

The liner material components transported by a water slurry are delivered to a hydraulic separator 320. The liner materials transported pneumatically are separated in pneumatic separators 322.

Each separator 322/320 is positioned immediately above a separate storage bin 324. As the liner material components are separated from their air or water carrier the material components 305 are deposited into their storage bins 324.

The storage bins 324 include a feeder means 326 attached to the bottom opening 332 of the bin 324. The storage bins 324 collect and hold liner component materials 305 used to form the tunnel lining 4.

The feeder means 326 controls the quantity of liner material components being sent to the mixers 330 from each storage bin 324. The liner component material 305 is sent to the mixers 330 through individual mixer feed pipes 328.

The composition of the liner material 36 is important with regard to the strength and setting characteristics of the liner material 36. Consequently, the feeder mechanisms 324 are controlled by the computer 210. The computer 210 monitors and adjusts the quantity of the liner material components 305 being sent to the mixers 330.

In operation, the component liner materials 305 are transported by the material retrieval system 500 to the feeder pipes 318. The feeder pipes 318 then deliver the liner component materials 305 to their individual separators 320/322. The separators 320/322 remove the water or air from the material components 305 and deposit the components 305 into the corresponding storage bin 324. The feeder means 326, monitored by the computer means 210, deposits the component materials 305 into the pipes 328. Finally, the components 305 are transported to the liner material mixing means 330. There the liner component materials 305 are mixed into the liner material 36 and prepared for injection into the slip form 302.

Liner Material Injection Subsystem 306

Depicted in FIG. 6 is an injection subsystem 306. The injection system 306 injects the mixed liner material 36 into the slip form 302. The injection subsystem 306 includes a pump 334, pipes 336, injectors 338, the thrust means 112 ("compactors") and a means of actuating the injector 340.

The pump 334 pumps the mixed liner material 36 from the material mixing subsystem 304 through the pipes 336 and into a liner injector 338.

The injector 338 is preferably a cylinder/piston device. The injectors 338 are controlled by an injector drive control means 340. The drive control 340 is monitored by the computer 210.

During and after injection of the liner material 36 into the injectors 338, the thrust means/compactors 112, compact the liner material 36 into the slip form 302. The compactors 112 also provide the propulsion to advance the entire tunneling machine 10.

The preferred compactors 112 are cylinder/piston type devices. The compactors 112 are pneumatically or hydraulically actuated by the control means 340.

EXCAVATION DEBRIS REMOVAL SYSTEM 400

Excavation waste and debris is created as the tunnel machine 10 advances and bores into the solid medium 8. The excavation waste or debris must be removed from the tunnel excavation area and disposed of. Excavation debris removal is one of the most time-consuming and troublesome areas for continuous tunneling machines. The rate at which the debris is removed is directly proportional to the speed at which the machine 10 can advance.

Figure 7:
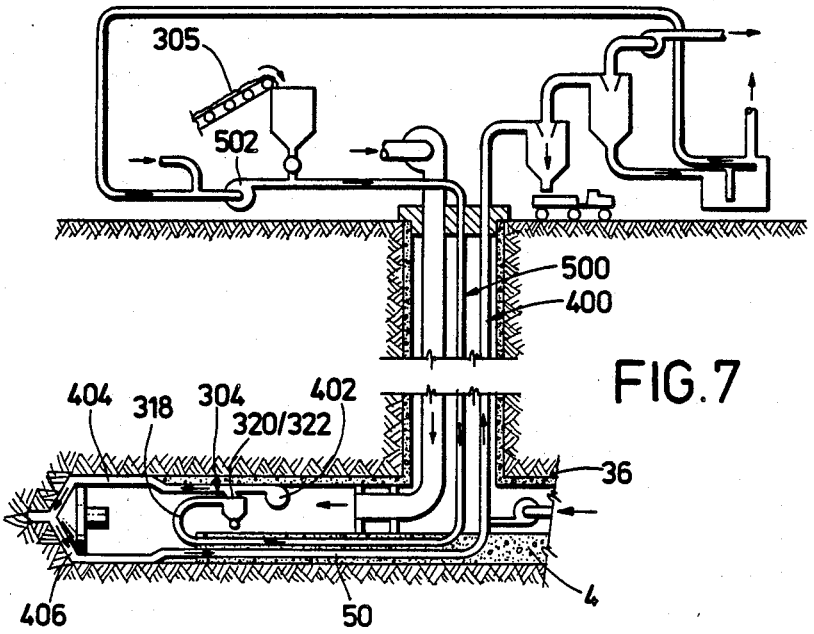
FIG. 7 is a schematic view of an entire continuous tunneling machine system.
Figure 8:
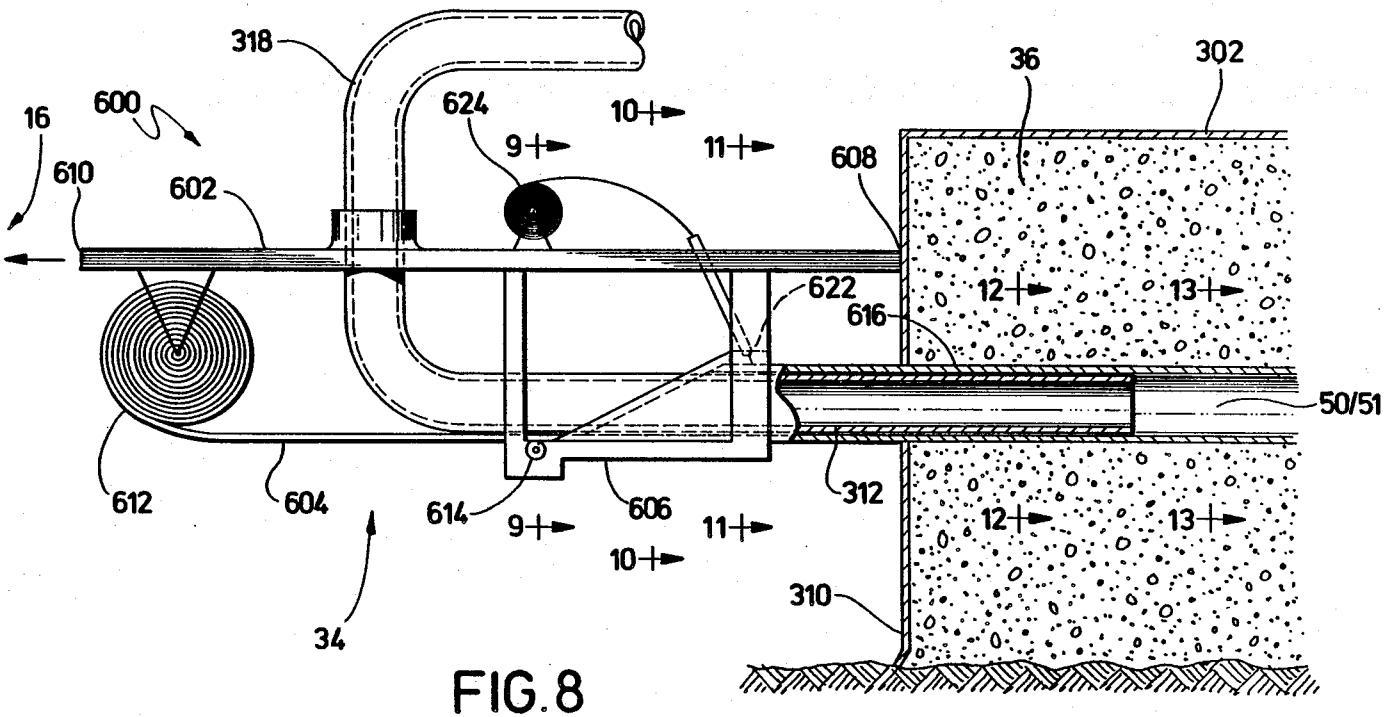
FIG. 8 is a side view of the sheet material lining system.
Figure 11:
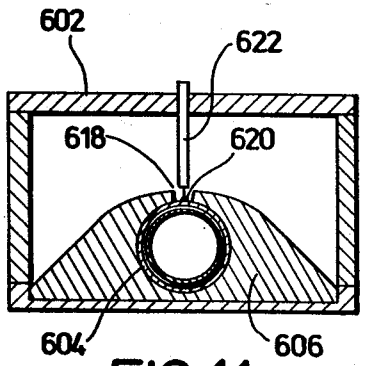
FIGS. 9 through 13 are sectional views of the wrapping jig of the sheet material lining system.
Figure 10:
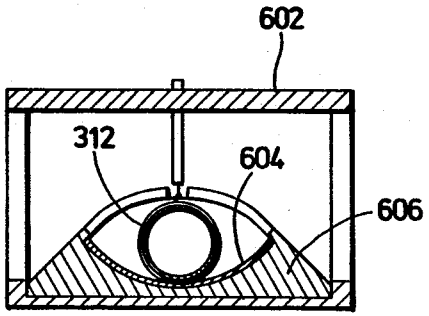
Figure 9:
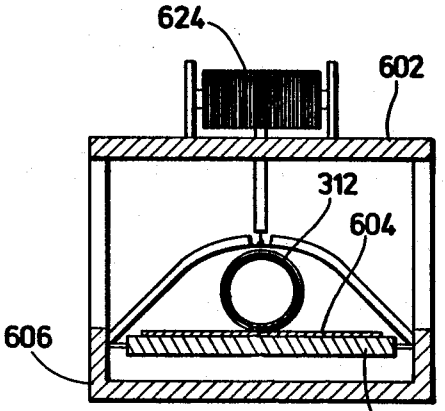
Figure 12:
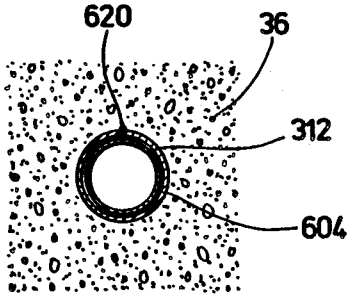
Figure 13:
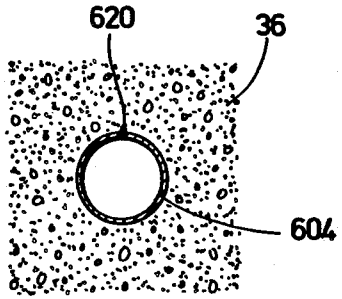

The preferred debris removal system 400 is shown in FIGS. 2, 5, and 7. The system 400 comprises a pump 402, pipe 404, an opening 406, passageway 408, the pipe mandrels 312 and passageways 50 formed in the tunnels lining 4.

The water and air removed from the separators 320/322 is pumped to the excavation bulkhead 16 through telescoping pipes 404. The pipes 404 are mounted to and through the bulkhead 16 and shield 18. FIG. 2 shows the pipes 404 in their preferred position.

The opening 406 at the base of the excavation area is the debris removal opening 406. Attached to that opening 406 is at least one telescoping removal passage 408. The passage 408 is mounted to and through the shield 18 and the bulkhead 16. Each debris removal passageway 408 is attached to one of the slip form's pipe mandrels 312.

In operation water and air is pumped into the excavation area. The water and air mixes with the excavation debris. The debris is forced out of the excavation compartment 32 through the opening 406 as more water and air is pumped into the excavation area.

The excavation debris then moves through the debris removal passageway 408 into a pipe mandrel 312. From there the slurry is transported through one of the passageways 50 formed in the liner 4 and out of the tunnel.

LINER COMPONENT MATERIAL RETRIEVAL SYSTEM 500

FIG. 7 depicts the machine's liner material retrieval system 500. The liner material retrieval system 500 includes passageway's 50 cast in the liner 4, the pipe mandrels 312, the feeder lines 318, and pumping means 502 The pump 502 pumps the liner component materials through the passageways 50 to the tunneling machine 10 from a remote location.

In the preferred embodiment, liner component materials are pumped through the cast in place passageways 50, through the pipe mandrels 312 and into the feeder pipes 318. The feeder pipes 318 then deliver the liner material components to their respective separators 320/322.

The material retrieval system 500 removes many of the problems associated with previously tunneling devices. For instance the cast in place passageways 50, formed in the tunnel lining 4, remove the need to add pipe as the machine 10 moves forward. Secondly, the system 500 provides liner component materials separately to the bulkhead. At the bulkhead the liner materials can be mixed in accord with the upcoming soil conditions. Consequently, the time required to shut down to add material retrieval pipe is alleviated.

PASSAGEWAY LINING SYSTEM 600

Illustrated in FIGS. 8 through 13 is a passageway lining system 600. The passageway lining system 600 is disposed in the rear compartment 34. The passageway lining system 600 includes the mandrels 312, a towing frame 602 connected to the wall 310, sheet material 604 connected to the towing frame 602 and wrapping jig 606 disposed around each mandrel 312.

Part of each mandrel 312 is disposed inside the rear compartment 34. The mandrel 312 serves as a template for the passageways 50 and as a connection to feed pipes 318.

The towing frame 602 is connected at one end 608 to the wall 310 and may be supported at the other end 610 by any number of means including connection to the bulkhead 16. During operation, the frame 602 supports the sheet material 604 and the wrapping jig 606, The sheet material 604 is preferably hung from the towing frame 602 by a roll 612. The roll 612 feeds the sheet material 604 to each wrapping jig.

The wrapping jig 606 is hung from the towing frame 602, positioned between the roll 612 of sheet material 604 and wall 310 and disposed around the mandrel 312. The jig 606 includes a roller 614 and is configured to direct the sheet material around the mandrel 312 in a spiraling fashion. This forms a complete lining 616 of the mandrel 312.

As the machine 10 continues to move forward, the lining 616 is exposed to liner material 36. The liner material 36 hardens around the lining 616 forming a lined passageway 51.

The passageway lining system 600 may also include a means for sealing 618 the seam 620 formed between adjacent sides of the lining material 604 as it is spiraled onto the mandrel 312. A metal seam welder 622 fed by electrode wire 624 or a thermal plastic material molded to the seam may provide a seal to the seam 620.

The principles, preferred embodiments, and methods of operations of the present invention have been described in this specification. The invention is not to be construed as limited to the particular forms disclosed, because they are regarded as illustrative rather than restrictive. Moreover, variations and changes may be made without departing from the spirit of the invention.

What is claimed is:

1. An apparatus for continuously and simultaneously boring and lining a tunnel comprising:

(a) a main structure comprising a housing, and a bulkhead disposed within the housing;

(b) a means for excavating the tunnel partially disposed within the housing and supported by the bulkhead;

(c) a means for lining the tunnel with a hardenable liner material where continuous passageways are formed in the liner to aid in removing excavation debris and retrieving the hardenable liner material without having to stop the apparatus to add pipe or other apparatus required to carry liner material or remove excavation debris;

(d) a means for retrieving the hardenable liner materials from a remote location to the means for lining the tunnel;

(e) a means for removing excavation debris through at least one continuous passageway; and (f) a means for controlling the means for:

i. excavating;

ii. lining;

iii. retrieving liner materials; and iv. removing excavation debris.

(g) a means for continuously lining the passageways with a sheet material.

2. An apparatus according to claim 1 where element (g) comprises (a) at least one mandrel;

(b) a jig disposed around each mandrel;

(c) a means for providing sheet material to the jig.

3. An apparatus according to claim 2 where element (g) further comprises a means for sealing the lining formed by the sheet material.

4. A method for continuously and simultaneously boring and lining a tunnel comprising the steps of:

(a) excavating a bore through a solid medium;

(b) lining the excavated bore where the lining comprises at least two continuous passageways formed in the lining;

(c) removing excavation debris through at least one of the continuous passageways formed in the lining;

(d) transporting hardenable liner material through at least one of the continuous passageways formed in the liner;

(e) lining the continuous passageways formed in the lining with a sheet material;

(f) controlling the excavation, lining, removal of excavation debris, and transportation of hardenable liner materials.

5. An apparatus for continuously and simultaneously boring and lining a tunnel comprising:

(a) a housing having an excavator end, liner end and a longitudinal axis;

(b) a bulkhead having an excavator side and liner side where the bulkhead is disposed within the housing substantially perpendicular to the housing's longitudinal axis;

(c) an excavation debris area defined by the area inside the housing between the excavator end of the housing and the excavator side of the bulkhead;

(d) a liner make-up area defined by the area between the liner side of the bulkhead and the liner end of the inner form;

(e) a slip form system comprising:

i. the housing as an outer form;

ii. an inner form having an excavator end and a liner end where the inner form is partially disposed within excavation debris area and shares substantially the same longitudinal axis as the housing;

iii. a wall connecting the outer form to the excavator end of the inner form where the wall is disposed substantially perpendicular to the housings longitudinal axis; and iv. at least one mandrel connected to the wall and disposed between the outer form and the inner form where the longitudinal axis of the mandrel is essentially parallel to the longitudinal axis of the housing;

(f) an excavator having:

i. a cutting head;

ii. a shaft attached to the cutter head;

iii. a motor;

iv. the shaft and motor are disposed within the housing and supported by the bulkhead; and v. the cutting head extends past the excavator end of the housing;

(g) means for lining the tunnel where a hardenable material is introduced into the slip form between the outer form and inner form and around each mandrel to form a tunnel lining having continuous cast-in-place passage ways formed by each mandrel;

(h) an excavation debris removal system comprising:

i. at least one mandrel;

ii. the cast-in-place passage way corresponding to each mandrel used;

iii. a debris pipe in fluid communication with the excavation debris area and each mandrel;

iv. means for introducing a fluid into the excavation debris area;

v. means for removing fluid and excavation debris from the excavation debris area through the pipe, mandrel and cast-in-place passage way and out the tunnel;

(i) means for driving the apparatus forward;

(j) means for lining the cast in place passageways with sheet material.

* * * * *